US007025074B2

(12) United States Patent
Porter

(10) Patent No.: US 7,025,074 B2
(45) **Date of Patent: *Apr. 11, 2006**

(54) FABRIC COVERED STRUCTURE AND METHOD OF ASSEMBLY OF SUCH STRUCTURE

(76) Inventor: William H. Porter, P.O. Box 249, Saugatuck, MI (US) 49453

( * ) Notice: Subject to any disclaimer, the term of this patent is extended or adjusted under 35 U.S.C. 154(b) by 0 days.

This patent is subject to a terminal disclaimer.

(21) Appl. No.: 11/065,249

(22) Filed: Feb. 24, 2005

(65) Prior Publication Data

US 2005/0138869 A1 Jun. 30, 2005

Related U.S. Application Data

(63) Continuation of application No. 10/308,561, filed on Dec. 3, 2002, now Pat. No. 6,874,518.

(51) Int. Cl.
*E04H 15/36* (2006.01)

(52) U.S. Cl. ..... 135/124; 135/119; 135/905; 403/109.1

(58) Field of Classification Search ..... 135/124, 135/114, 115, 119, 120.3, 130, 905; 52/63, 52/83; 403/109.1, 109.4, 109.7, 377
See application file for complete search history.

(56) References Cited

U.S. PATENT DOCUMENTS

| | | | | |
|---|---|---|---|---|
| 1,592,128 | A * | 7/1926 | Steinbreder | 135/118 |
| 1,642,267 | A | 9/1927 | Rush | |
| 2,001,196 | A | 5/1935 | Jost | |
| 2,935,074 | A | 5/1960 | Baker | |
| 3,095,069 | A | 6/1963 | Winkler | |
| 3,327,723 | A | 6/1967 | Burgin | |
| 3,333,373 | A | 8/1967 | Taylor et al. | |
| 3,335,535 | A | 8/1967 | Lane | |
| 3,367,348 | A | 2/1968 | Kirkham | |
| 3,371,671 | A * | 3/1968 | Kirkham | 135/139 |
| 3,574,375 | A * | 4/1971 | Scott | 403/104 |
| 3,834,410 | A | 9/1974 | Leibel | |
| 3,952,463 | A | 4/1976 | Lane | |
| 4,192,334 | A * | 3/1980 | Daws | 135/135 |
| 4,726,153 | A | 2/1988 | Adler et al. | |
| 5,035,253 | A | 7/1991 | Bortles | |
| 5,234,011 | A * | 8/1993 | Lynch | 135/99 |
| 5,307,829 | A * | 5/1994 | Dalo et al. | 135/128 |
| 5,487,402 | A | 1/1996 | Clary | |
| 6,357,461 | B1 * | 3/2002 | Chai et al. | 135/88.09 |
| 6,651,685 | B1 | 11/2003 | Connelly et al. | |
| 6,691,723 | B1 | 2/2004 | Godbersen | |
| 6,814,094 | B1 * | 11/2004 | Barber | 135/119 |

* cited by examiner

*Primary Examiner*—Janet M. Wilkens
(74) *Attorney, Agent, or Firm*—Price, Heneveld, Cooper, DeWitt & Litton LLP

(57) ABSTRACT

A fabric covered structure such as for use as a gazebo or pavilion includes plural generally vertical support columns connected to roof beams which support a fabric roof. Opposed ends of the beams are each connected to one of the support columns and are each provided with a hook element for attachment to a cable or rope attached to the periphery of the fabric roof such as by being disposed in a peripheral hem of the fabric roof. Each roof beam is further provided with telescoping end portions to each of which is attached one of the hook elements for extending the end of the beam and maintaining the cable under tension and the fabric roof in a stretched condition.

24 Claims, 10 Drawing Sheets

FABRIC COVERED STRUCTURE AND METHOD OF ASSEMBLY OF SUCH STRUCTURE

CROSS REFERENCES TO RELATED APPLICATION

This application is a continuation of application Ser. No. 10/308,561, filed Dec. 3, 2002, entitled FABRIC COVERED STRUCTURE AND METHOD OF ASSEMBLY OF SUCH STRUCTURE, (now U.S. Pat. No. 6,874,518, issued Apr. 5, 2005).

FILED OF THE INVENTION

This invention relates generally to shelters such as gazebos and pavilions and is particularly directed to a fabric covered structure, or shelter, and a method of assembly of such structure.

BACKGROUND OF INVENTION

Structures such as gazebos and pavilions as used in parks, yards and gardens are increasingly being provided with a fabric roof because of improvements in the composition and characteristics of fabric materials used in such applications. The fabric is positioned on and secured to support elements such as roof beams or rafters. The fabric roof is typically maintained in a tightly stretched condition to prevent damage to the fabric such as by wind, rain, ice and snow and to securely maintain it in position on the upper portion of the structure or shelter. Because fabric materials generally stretch over time when maintained taut by an applied stretching force, the tension applied to the fabric material typically is reduced over time. For a fabric roof, this can result in damage such as by tearing by any one of the aforementioned natural forces or by detachment of the fabric roof from its support structure.

There are currently a number of different approaches for securing a fabric roof to a structure and maintaining it in position thereon. One approach involves the use of hand-pulled cables attached to various points located above or within the periphery of the fabric roof for tightly pulling the fabric over an upper portion of the support structure. Once stretched over the support structure, the fabric roof is maintained in position on the support structure by eyes or fingers connecting the cables to the support structure. Another approach employs a cable or rope attached to and disposed about the periphery of the fabric roof which is positioned on an upper portion of the support structure. A turnbuckle connects opposed ends of the cable, or plural turnbuckles couple adjacent ends of plural segments of the cable, for pulling the cable, or cable segments, tightly about the periphery of the support structure. The tension applied to the cable, or cable segments, and thus to the periphery of the fabric roof, maintain it securely in position on the support structure. In these types of approaches, the cable clamps or turnbuckles are disposed immediately adjacent to or within a peripheral portion of the fabric roof rendering the tightening of the cable(s) difficult and time consuming. In addition, the fabric tends to stretch and loosen over time resulting in a loss of tension applied to the fabric roof increasing the likelihood of damage to or loss of the fabric roof.

The present invention addresses the aforementioned limitations of the prior art by providing a structure, or shelter, having telescoping roof beams, each of which is connected at its outer end to a cable attached to the periphery of a fabric roof. The telescoping ends of the roof beams may be extended outwardly or retracted inwardly by merely turning a screw to adjust the tension applied to the stretched fabric roof. The stretching force applied to the fabric roof is uniform about its periphery and the connection between the telescoping ends of the roof beams and the fabric roof's peripheral cable prevents loss of tension in the stretched fabric roof.

SUMMARY OF THE INVENTION

In one aspect of the present invention, a building structure comprises one or more support columns. A roof support structure includes at least one roof beam attached to an upper portion of said one or more support columns. A roof comprised of fabric is disposed on said roof support structure, wherein peripheral portions of said fabric roof are attached to opposed ends of said at least one roof beam. At least one of said roof beams includes at least one telescoping member associated with and coupled to said at least one roof beam and further includes a forced extension device adapted to telescopingly extend said at least one telescoping member and hold a length of said at least one roof beam so as to displace the peripheral portions of said fabric roof away from inner portions of the fabric roof to thus tension and then maintain said fabric roof in a stretched condition under tension on said roof support structure.

In another aspect of the present invention, a building structure comprises one or more support columns. A roof support structure includes at least one roof beam attached to an upper portion of said one or more support columns. A roof comprised of fabric is disposed on said roof support structure, wherein peripheral portions of said fabric roof are attached to opposed ends of said at least one roof beam. At least one telescoping member is coupled to or disposed in said at least one roof beam and further coupled to a peripheral portion of said fabric roof for adjusting the length of said at least one roof beam and maintaining said fabric roof in a stretched condition under tension on said roof support structure; said telescoping members being disposed on opposed ends of each of said roof beams; wherein said roof support structure includes plural roof beams each having first and second opposed ends, with one of said telescoping members being disposed on each of said first and second ends of each of said plural roof beams, wherein at least one of said telescoping member includes first and second axially aligned concentric members and a tension screw coupled to said axially aligned concentric members for displacing said axially aligned members in a telescoping manner relative to one another, an outer one of said concentric members defining a linear cavity with an open end and the screw shaft extending within the linear cavity and through the open end.

Another aspect of the present invention includes a method for installing a fabric roof having an inner portion and an outer peripheral portion on a building structure including one or more roof beams, said method comprising the steps of positioning the fabric roof on said one or more roof beams, the fabric including a perimeter; attaching the perimeter of the fabric roof to opposed ends of said one or more roof beams; and rotating a threaded shaft to telescopically extend and hold said one or more roof beams so as to displace the perimeter of said fabric roof away from an inner portion thereof and to maintain said fabric roof in a stretched condition on said one or more roof beams.

In yet another aspect of the present invention, a building structure comprises at least one support column. A roof support structure includes a plurality of roof beams supported by said at least one support column. A fabric roof is supported on the roof support structure and has a perimeter attached to ends of the roof beams. At least one of the roof beams is telescopingly extendable and has at least one forced extension device operably connected thereto and is configured to forcibly extend a length of the at least one roof beam to an adjusted length dimension to both tension the fabric roof, and to fixedly hold a selected length dimension until again adjusted regardless of increased or decreased tension on the fabric roof due to wind and weather.

Another aspect of the present invention includes a method of constructing a building structure comprising a step of providing at least one support column. Another step provides a roof support structure including a plurality of roof beams supported by said at least one support column, at least one of the roof beams being telescopingly extendable. Another step provides a fabric roof supported on the roof support structure and having a perimeter attached to ends of the roof beams. Still another step includes providing a forced extension device for forcibly extending a length of the at least one roof beam to a set adjusted position to tension the fabric roof, and forcibly telescopingly extending the at least one roof beam to a selected length causing the at least one roof beam to pull on the perimeter of the fabric roof and tension the fabric roof and then holding the selected adjusted length until again adjusted regardless of increased or decreased tension on the fabric roof due to wind and weather.

These and other aspects, objects, and features of the present invention will be understood and appreciated by those skilled in the art upon studying the following specification, claims, and appended drawings.

BRIEF DESCRIPTION OF DRAWINGS

The appended claims set forth those novel features which characterize the invention. However, the invention itself, as well as further object and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
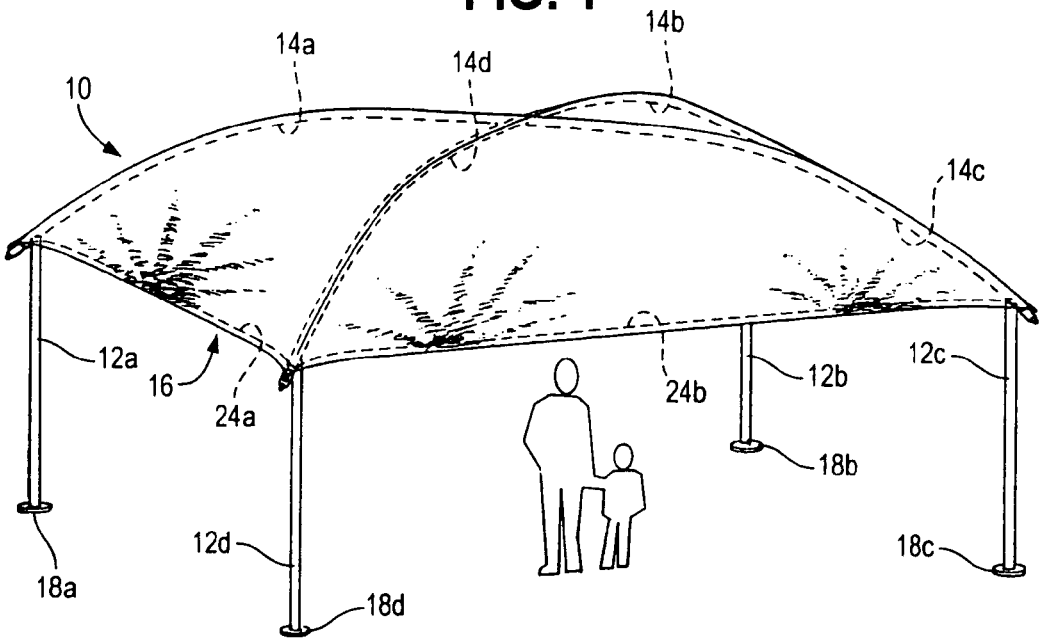
FIG. 1 is a perspective view shown partially in phantom of a building structure such as a gazebo or pavilion incorporating a fabric roof in accordance with one embodiment of the present invention.

Referring to FIG. 1, there is shown an upper perspective view of a fabric covered structure 10 in accordance with one embodiment of the present invention. The fabric covered structure 10 includes first, second, third and fourth generally vertical support columns 12*a*–12*d*. The lower end of each of the four support columns 12*a*, 12*b*, 12*c*, and 12*d* is connected to a respective support column base 18*a*, 18*b*, 18*c*, and 18*d*. Each of the support column based 18*a*–18*d* is adapted for positioning on and/or insertion in a support surface such as the ground or a concrete slab which is not shown in the figure for simplicity. The upper end of each of the support columns 12*a*–12*d* is connected to a roof support structure which is shown in dotted line form in the figure. The roof support structure includes first, second, third and fourth roof beams 14*a*–14*d*, which are shown in the figure in dotted line form. Thus, the upper ends of the first through fourth support columns 12*a*–12*d* are respectively coupled to outer end portions of roof beams 14*a*–14*d*. The roof support structure is described herein in terms of four inner connected roof beams, but may equally as well be comprised of two crossed and connected roof beams. However, the present invention is not limited to the number or arrangement of the roof beams within the roof support structure shown in FIG. 1. Similarly, while the roof beams shown in FIG. 1 provide a domed surface for supporting a fabric roof or cover 16, the present invention is not limited to a fabric roof in the shape of a dome, but contemplates virtually any roof configuration as illustrated and discussed below, even including a flat fabric roof.

As shown in FIG. 1, the fabric roof 16 is disposed on the four roof beams 14*a*–14*d*, with the periphery of the fabric roof extending to a location adjacent the respective distal ends of the four roof beams. The fabric roof 16 may be comprised of virtually any fabric material provided that is pliable or flexible, and is strong enough to accommodate a stretching force applied to a peripheral edge or edges of the fabric roof to maintain it under tension. In most applications, the fabric roof 16 would be comprised of a lightweight material which is dense enough to provide shade from the sun and to also be water resistant or waterproof, as well as strong enough to withstand reasonably high wind loading and reasonably heavy loads of ice and snow.

Figure 2:
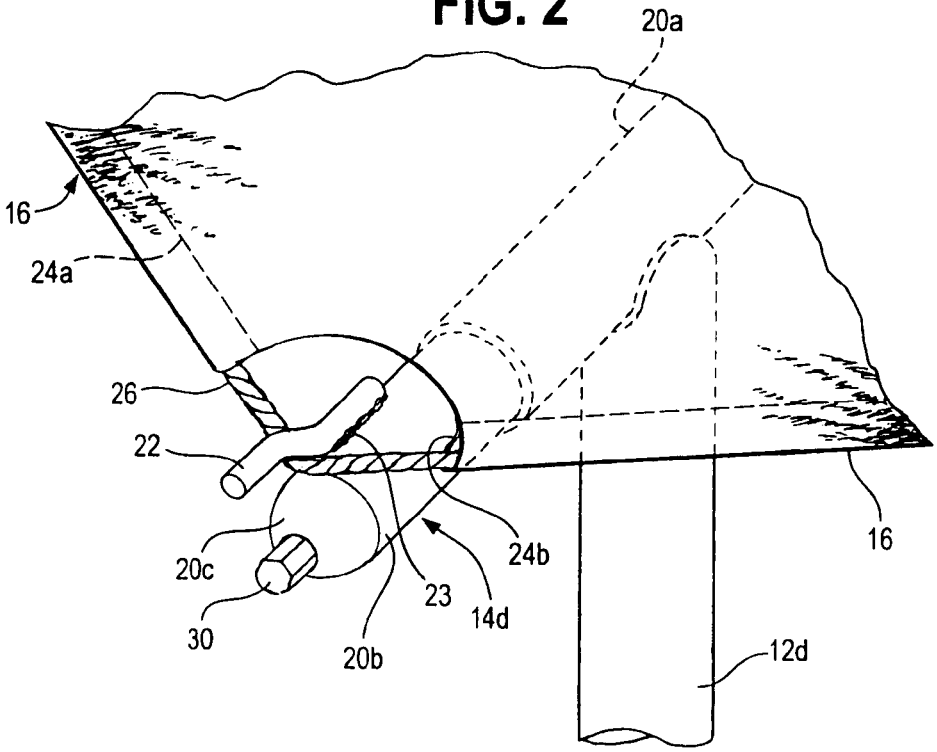
FIG. 2 is a perspective view shown partially in phantom of a corner portion of a fabric roof and the manner in which the fabric roof is secured to an upper portion of a support structure in accordance with the present invention.
Figure 3:
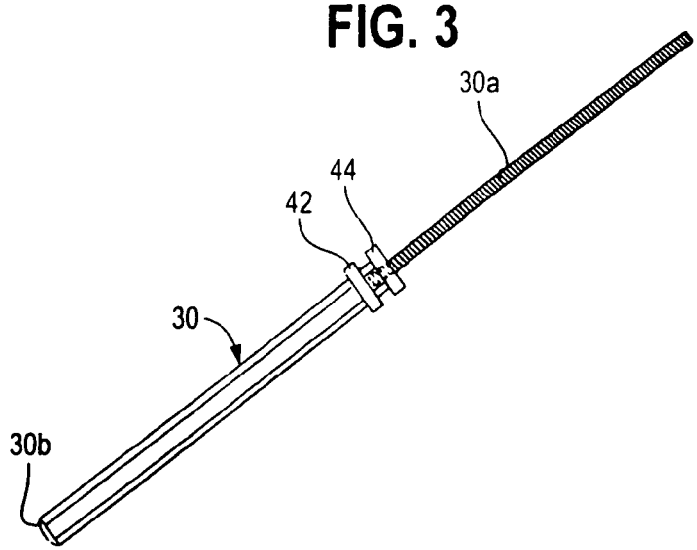
FIG. 3 is a side elevation view shown partially in phantom of a tensioning screw used in the fabric roof attachment and tensioning arrangement of the present invention.
Figure 4:
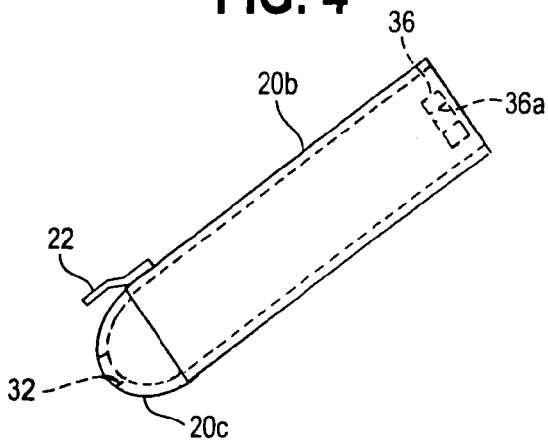
FIGS. 4 and 5 shown partially in phantom are side elevation views of end portions of a telescoping roof beam for attaching a fabric roof to a support structure and maintaining the fabric roof under tension in accordance with the present invention.
Figure 4A:
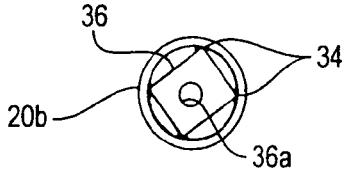
FIGS. 4*a* and 5*a* are end-on views of the components of the telescoping roof beam respectively shown in FIGS. 4 and 5 taken along sight lines 4*a*—4*a* and 5*a*—5*a*, respectively.
Figure 5:
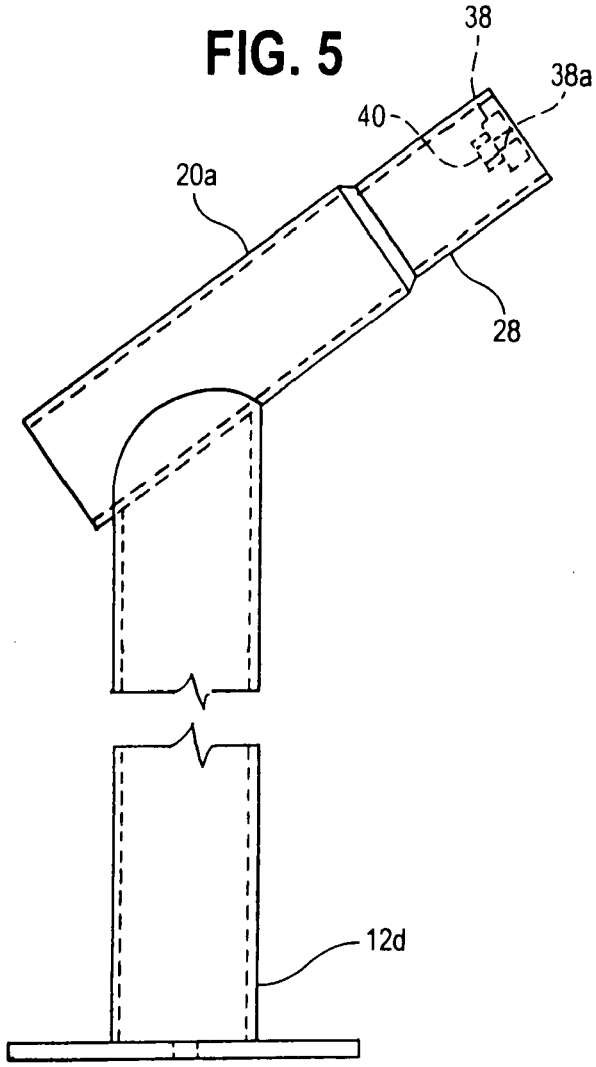
Figure 6:
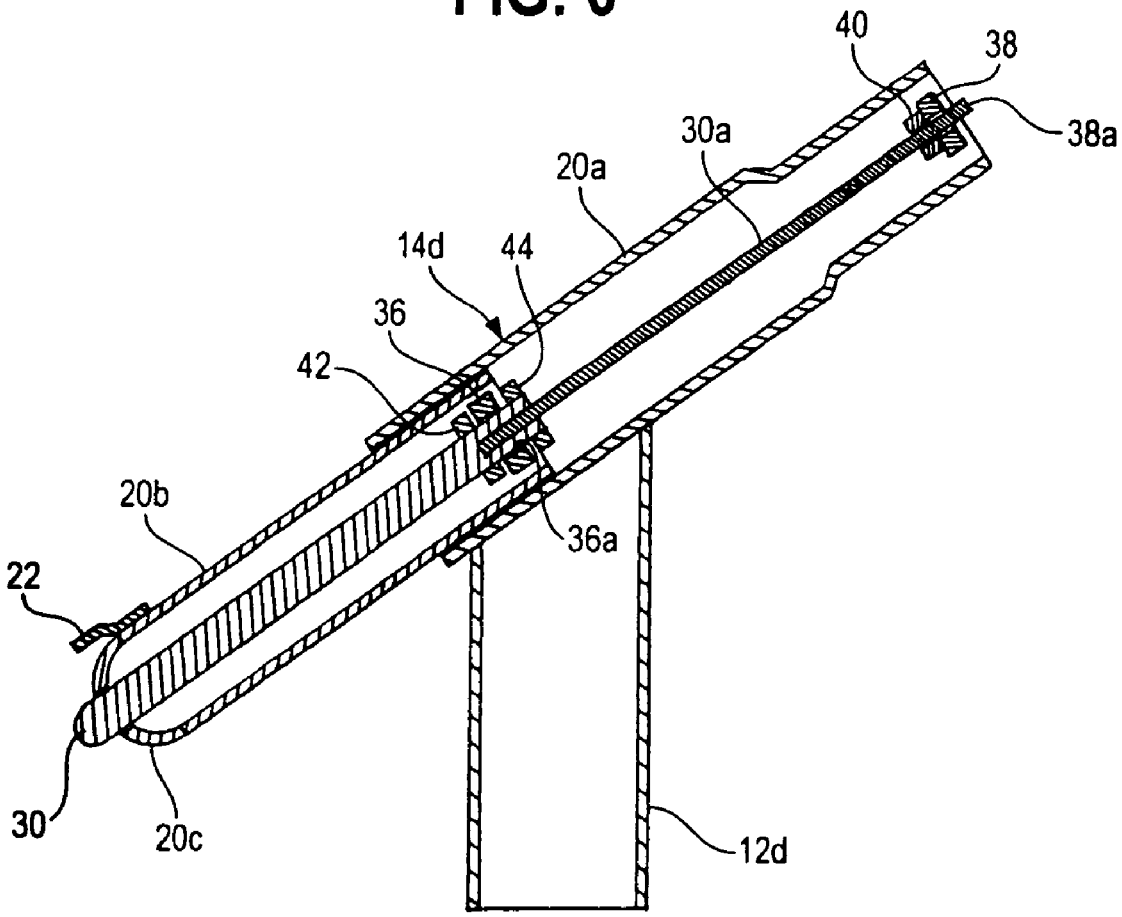
FIGS. 6 and 7 are respectively lateral sectional and side elevation views of the telescoping end of a roof beam used in the fabric roof mounting and tensioning arrangement of the present invention.
Figure 7:
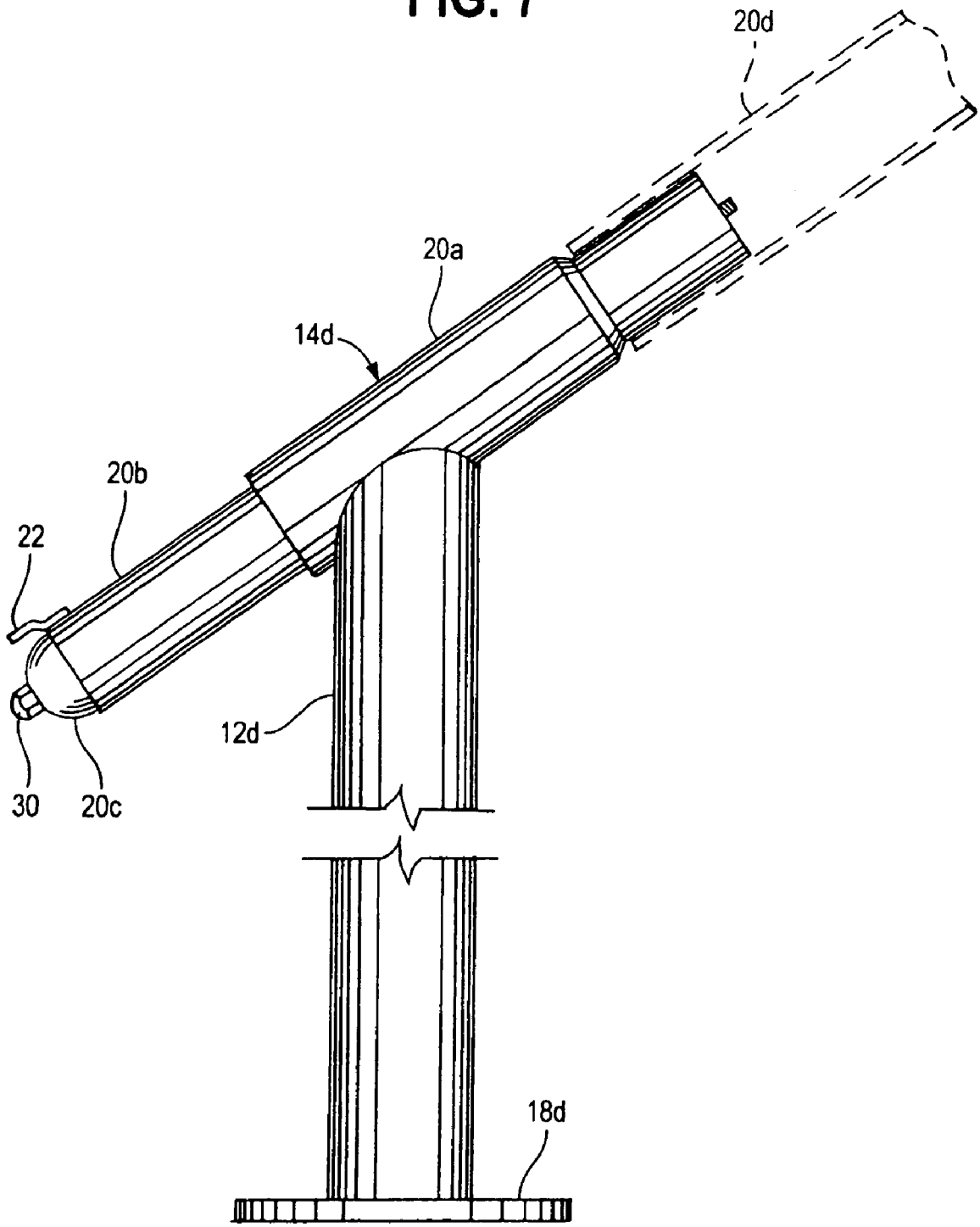

Referring to FIG. 2, there is shown partially in phantom a perspective view of a peripheral portion of the fabric roof 16 and the manner in which it is connected to an end of a roof beam 14*d* in accordance with one embodiment of the invention. The manner in which the fabric roof 16 is secured to the roof support arrangement of the fabric covered structure 10 and is maintained in a stretched condition under tension will now be described with reference also to FIGS. 3–7. FIG. 3 is a side elevation view shown partially in phantom of a tensioning screw 30 used in the fabric roof mounting and stretching arrangement of the present invention. FIGS. 4 and 5 shown partially in phantom illustrate components in the telescoping end portion of a roof beam for attaching the fabric roof 16 to the roof support arrangement and maintaining it in a stretched condition. FIGS. 6 and 7 are respectively lateral sectional and side elevation views of a roof tensioning arrangement incorporated in the ends of each of the roof beams, such as roof beam 14*d* which is coupled to and supported by one of the support columns 12*d* as shown in the figure.

Figure 5A:
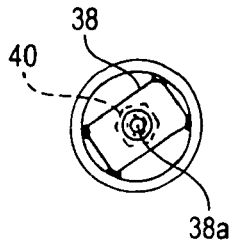

The outer end of roof beam 14*d* is securely attached to an upper end of the fourth support column 12*d* by conventional means such as weldments (not shown for simplicity). Roof beam 14*d* is comprised of an intermediate roof beam member 20*a*, an outer roof beam member 20*b* having a curved end portion 20*c*, and an inner roof beam member 20*d*, where the term "inner" is taken to mean in a direction toward the center of the building structure and the term "outer" is in a direction toward the distal end of the roof beam. The intermediate roof beam member 20*a* is attached to support column 12 and is tapered adjacent its inner end so as to fit within the open end of the inner roof beam member 20*d* in a telescoping manner. Similarly, the outer roof beam member 20*b* is adapted for insertion in the open outer end of the intermediate roof beam member 20*a* in a telescoping manner. The curved end portion 20*c* of the outer roof beam member 20*b* is provided with a circular aperture 32 as shown in dotted line form in FIG. 4. Inserted through the aperture 32 within the curved end portion 30*c* of the outer roof beam member 30*b* is an elongated tensioning screw 30. Tensioning screw 30 is provided with an inner threaded portion 30*a* and an outer hexagonal end portion 30*b*. Attached in a spaced manner to an intermediate portion of the tensioning screw 30 are first and second retaining collars or shoulders 42 and 44. The first retaining collar 42 is slipped in and attached to the screw's outer hexagonal end portion 30*b* by conventional means such as weldments which are not shown for simplicity. The second retaining collar 44 includes a threaded aperture adapted for attachment to the screw's inner threaded portion 30*a*. Disposed within the inner end of the outer roof beam member 20*b* is a first end plate 36 having a circular aperture 36*a* therein. The first end plate 36 is securely attached to the inner surface of the outer roof beam member 20*b* adjacent its inner end by conventional means such as weldments 34. The first end plate 36 is positioned between the first and second retaining collars 42 and 44 and is maintained in fixed position on the tensioning screw 30 by first and second retaining collars. The first end plate 36 of the outer roof beam member 20*b* may be attached to the tensioning screw 30 by inserting the end portion 30*b* of the tensioning screw 30 with the first retaining collar 42 attached into the outer roof beam member 20*b*. The first end plate 36 is then positioned on the inner end of the tensioning screw's outer end portion 30*b* and is attached to the outer roof beam member's inner surface such as by weldments 34. The outer end of the tensioning screw's inner threaded portion 30*a* bearing the second retaining collar 44 is then threadably attached to the inner end of the tensioning screw's outer end portion 30*b*. The connection between the tensioning screw 30 and the outer roof beam member 20*b* is such that the tensioning screw is freely rotatable within the outer roof beam member, but the two are coupled together so that the outer roof beam member moves with the tensioning screw along the longitudinal axis of the fourth roof beam 14*d*. Disposed within the inner end portion having a reduced diameter of the intermediate roof beam member 20*a* is a second end plate 38. The second end plate 38 is securely affixed to the inner surface of the intermediate roof beam member 20*a* by conventional means such as weldments as shown in the end-on view of FIG. 5*a*. The second end plate 38 also has a circular aperture 38*a* therein. The inner threaded portion 30*a* of the tensioning screw 30 is inserted through aperture 38*a* within the second end plate 38 also as shown in the sectional view of FIG. 6. With the tensioning screw 30 inserted through the aligned apertures 32, 36*a* and 38*a*, the elongated tensioning screw is maintained in alignment along the longitudinal axis of roof beam 14*d*. The distal ends of the first, second and third roof beams 14*a*, 14*b*, and 14*c* are similarly configured.

Attached by conventional means such as a weldment to the inner surface of the second end plate 38 is a nut 40 through which the inner threaded portion 30*a* of the tensioning screw 30 is inserted. Rotation of the tensioning screw 30 in a first direction causes the tensioning screw and the outer roof beam member 20*b* to move inwardly within the intermediate roof beam member 20*a*. Rotation of the tensioning screw 30 in a second opposed direction causes the combination of the tensioning screw and the outer roof beam member 20*b* to which it is attached to move outwardly from the intermediate roof beam member 20*a* thus making the fourth roof beam 14*d* of greater length. It is in this manner that the length of each of the roof beams may be increased or decreased by rotation of a tensioning screw inserted into the end of the roof beam.

Disposed on the distal end of the fourth roof beam 14*b* is a hook member 22. More specifically, the hook member 22 is securely attached by conventional means such as a weldment 23 to a distal outer portion of the movable outer roof beam member 20*b*. Hook 22 is adapted for engagement with a cable or rope 26 attached to and disposed about the periphery of the fabric roof 16 as shown in FIG. 2. Peripheral edges of the fabric roof 16 are provided with hem portions so as to enclose portions of the cable 26 as shown in FIG. 2 for the case of first and second roof hems 24*a* and 24*b*. By rotating the tensioning screw 30 in a clockwise direction as viewed in FIG. 2, the length of the fourth support column 14*d* is reduced by the retraction of the outer roof beam member 20*b* into the intermediate roof beam member 20*a*. In this case, the inward movement of the hook 22 engaging cable 26 reduces the force applied to the cable and the tension in the cable. Conversely, counter-clockwise rotation of the tensioning screw 30 as viewed in FIG. 2 will cause the outer roof beam member 20*b* to extend out farther from the intermediate roof beam member 20*a* increasing the force exerted on the cable 26 by the hook 22 and the tension within cable. By thus applying a fixed and selectable tension on cable 26, the fabric roof 16 may be maintained in a highly stretched condition. Increasing the tension on the fabric roof will maintain the fabric roof in a tightly stretched condition as it ages and becomes stretched over time. On the other hand, reducing the length of each of the roof beams as just described will result in a reduction in the tensioning force applied to the fabric roof 16. By moving the cable-engaging hooks sufficiently inwardly, all tension may be removed from the roof's cable, allowing the fabric roof to be repaired or replaced.

Figure 8:
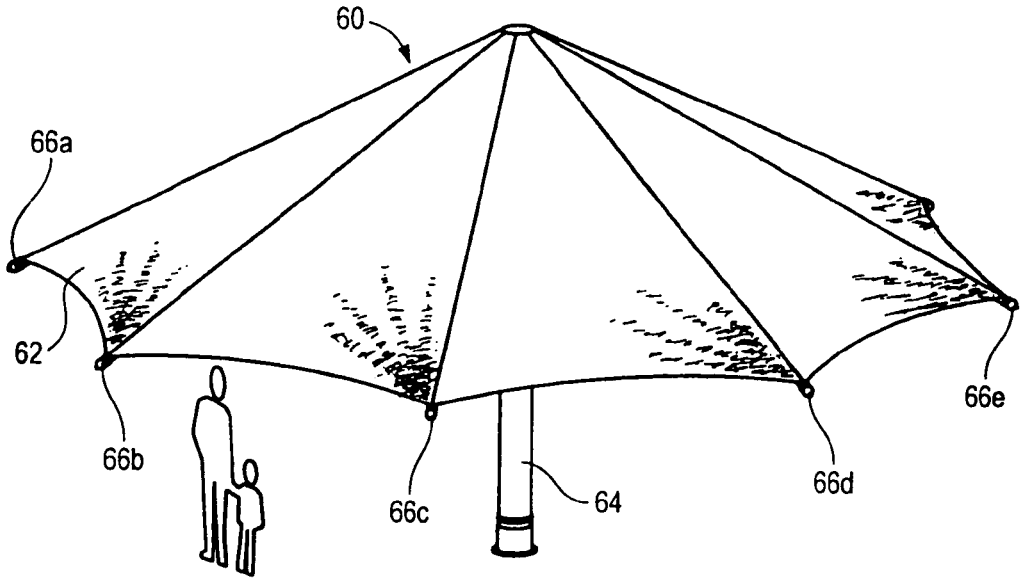
FIG. 8 is a perspective view of another embodiment of a fabric roof covering a structure, or shelter, in accordance with the present invention, where the structure has a single support column.
Figure 9:
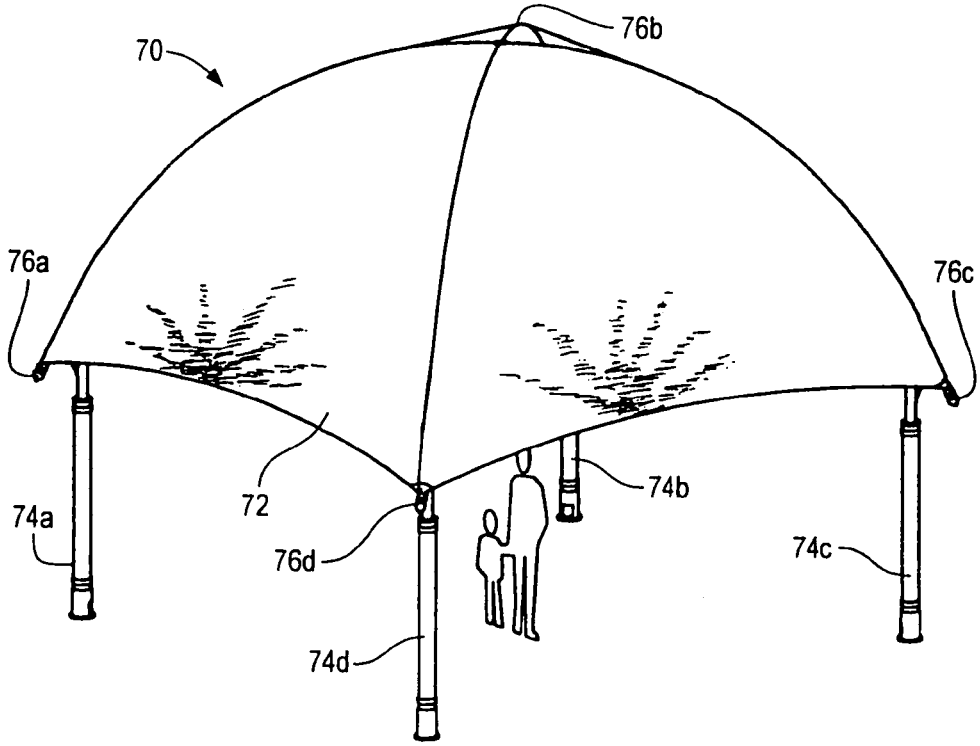
FIG. 9 is an upper perspective view of yet another structure incorporating a fabric roof attached to an upper portion of the structure in accordance with another embodiment of the present invention.

Referring to FIGS. 8 and 9, there are shown other embodiments of a building structure or shelter having a fabric roof in accordance with the principles of the present invention. FIG. 8 is an upper perspective view of a fabric covered structure 60 having a fabric roof 62 which is supported by a single support column 64. Structure 60 includes a roof support arrangement comprised of plural radially arranged roof beams, where the ends of five of the roof beams are shown as elements 66*a*–66*e*. The distal ends of each of the radially extending roof beams 66*a*–66*e* is provided with a telescoping arrangement as previously described for engaging a peripheral cable within the fabric roof 62 and maintaining the fabric roof in a stretched condition under tension. FIG. 9 is an upper perspective view of yet another embodiment of a fabric covered structure 70 in accordance with the present invention. The fabric covered structure 70 includes a roof support arrangement including roof beams 76*a*–76*d*, each of which engages a peripheral cable within the fabric roof 72 and maintains the cable as well as the roof in a stretched condition. As in the first described embodiment of the present invention, the fabric covered structure 70 shown in FIG. 9 includes four support columns 74*a*–74*d*, but has a more arched fabric roof structure than that of the structure shown in FIG. 1.

Figure 10:
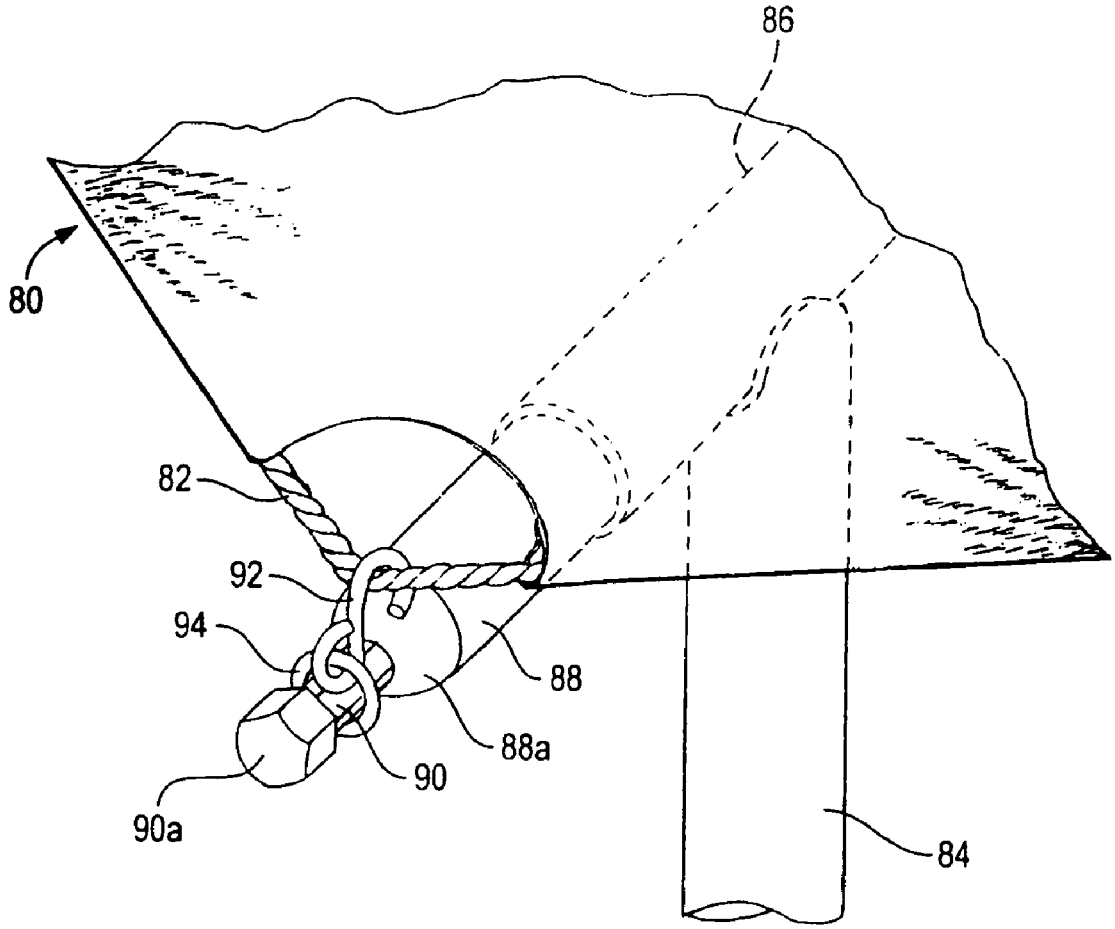
FIG. 10 is a perspective view shown partially in phantom of a portion of a building structure such as a gazebo or pavilion incorporating a fabric roof in accordance with another embodiment of the present invention.
Figure 11:
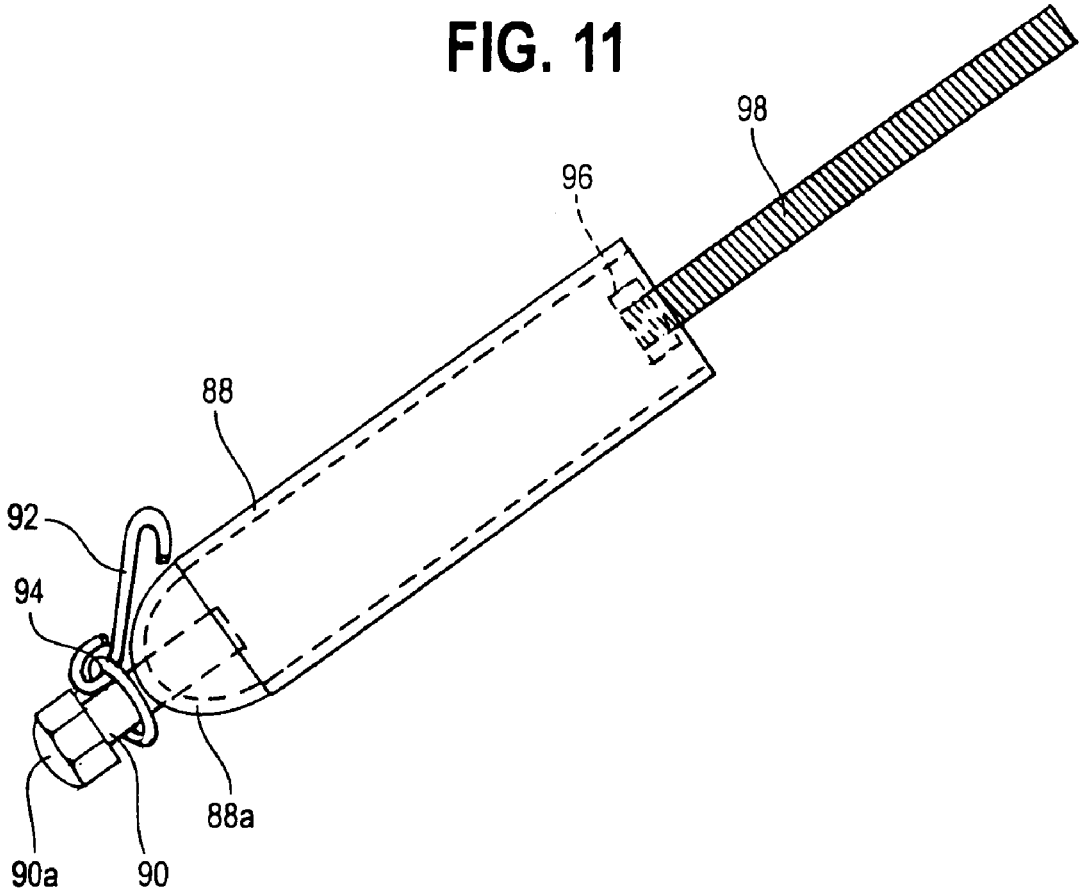
FIG. 11 is a side view shown partially in phantom of a telescoping roof beam member for maintaining the fabric roof in a stretched condition in accordance with the second embodiment of the present invention shown in FIG. 10.
Figure 12:
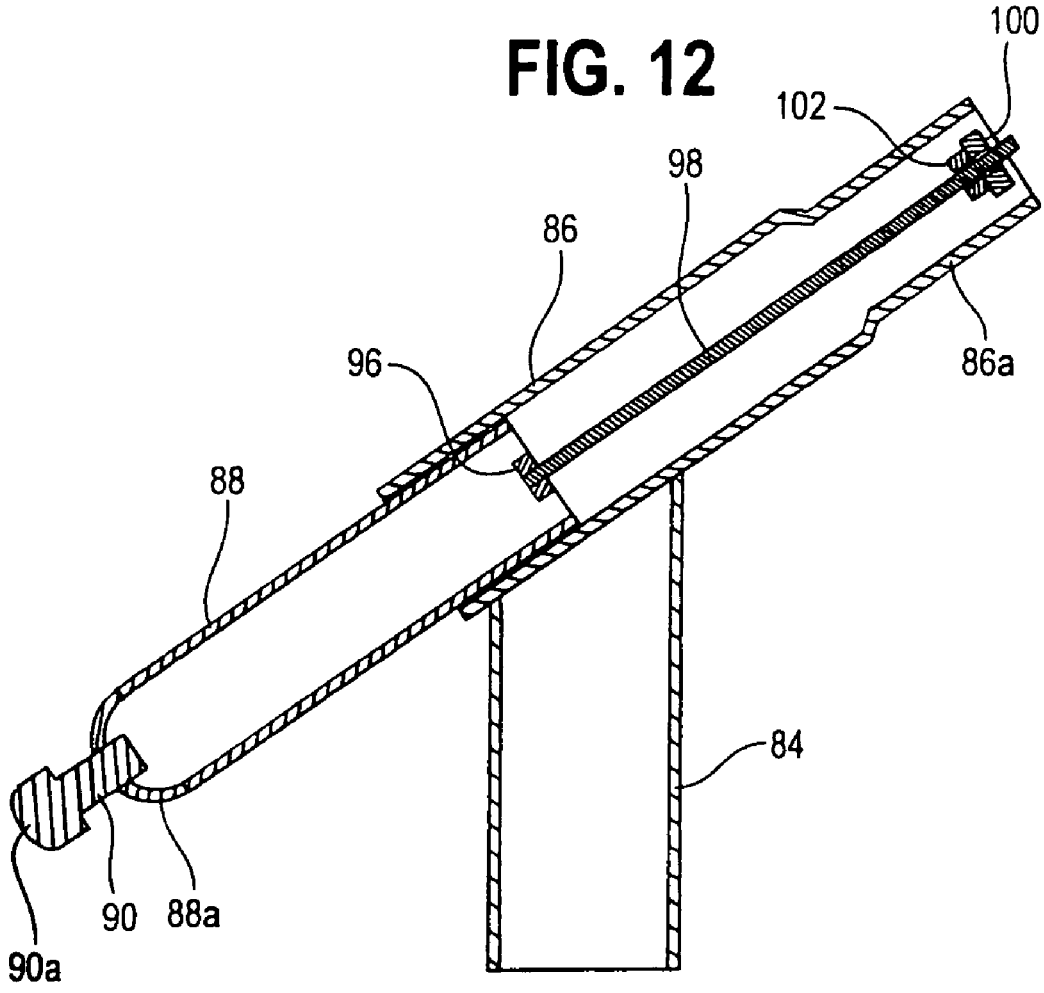
FIGS. 12 and 13 are respectively lateral sectional and side elevation views of the telescoping end of a roof beam used in the fabric roof mounting and tensioning arrangement in the second embodiment of the present invention as shown in FIG. 10.
Figure 13:
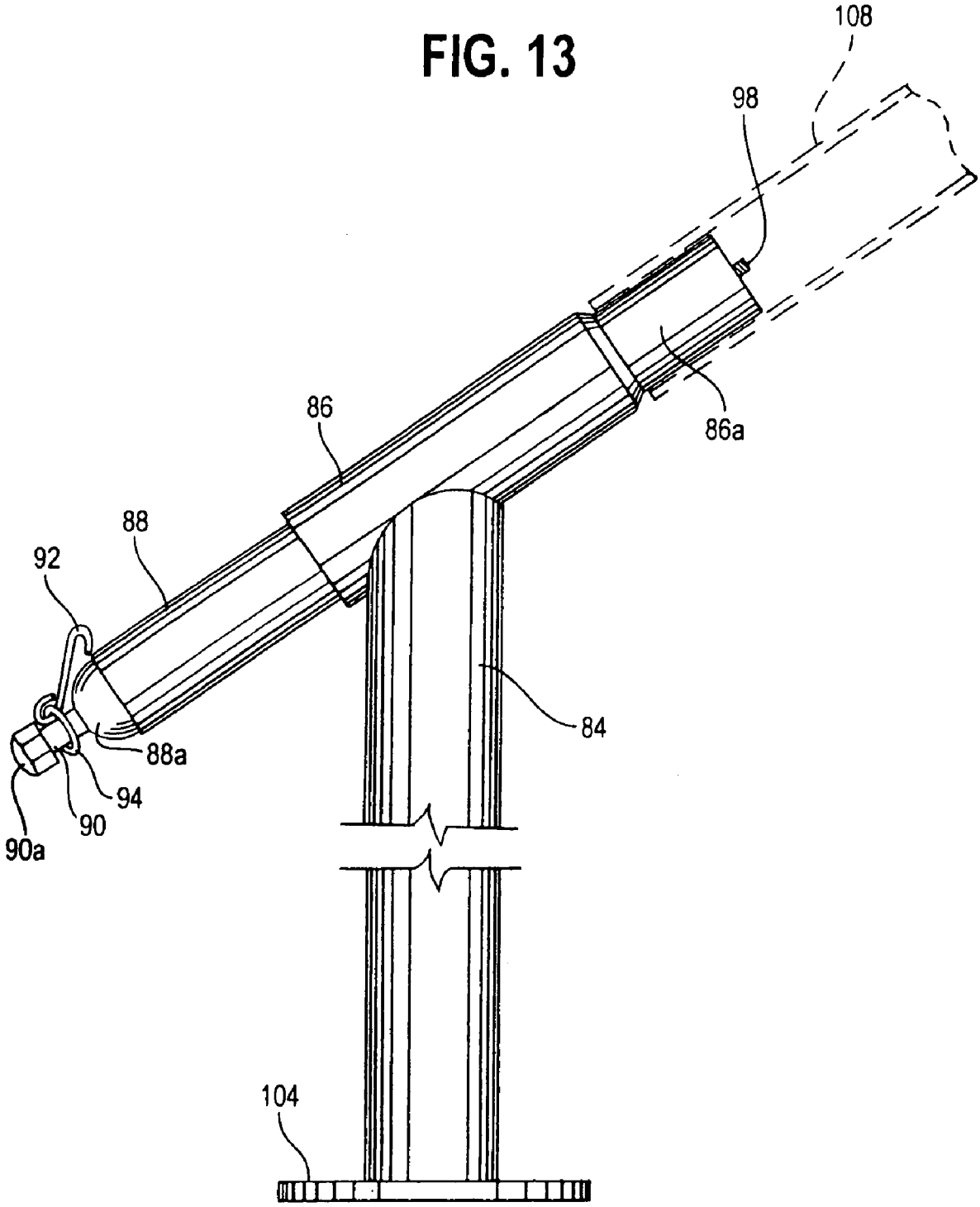

Referring to FIG. 10, there is shown a perspective view shown partially in phantom of a portion of a building structure such as a gazebo or pavilion incorporating a fabric roof 80 in accordance with another embodiment of the present invention. FIG. 11 is a side elevation view shown partially in phantom of a telescoping outer roof beam member 88 used in the roof mounting and stretching arrangement shown in FIG. 10. FIGS. 12 and 13 are respectively lateral sectional and side elevation views of a fabric roof mounting and stretching arrangement in accordance with the second embodiment of the present invention.

As shown in the embodiment of FIG. 10, the fabric roof 80 is attached to a cable or rope 82 disposed about the periphery of the fabric roof. As in the previously described embodiment, cable 82 may be disposed in a hem (not shown for simplicity) disposed about the outer edge of the fabric roof 80. Each roof rafter is comprised of plural telescoping members which are attached to and supported by a respective support column 84, which, in turn, is positioned on and attached to a support column base 104. The building structure may include virtually any number of vertical support columns, with each support column typically, although not necessarily, associated with a respective corner of the fabric roof 80 as shown in FIG. 10. Thus, in the embodiment shown in FIGS. 10–13, the roof rafter includes an outer roof beam member 88, an intermediate roof beam member 86 and an inner roof beam member 108 (shown in FIG. 13 in dotted line form). The distal end 88*a* of the outer roof beam member 88 is curved in configuration and includes an aperture therein. The outer roof beam member 88 is telescopically inserted within the intermediate roof beam member 86 and is freely displaceable therein along the longitudinal axis of the roof rafter. Similarly, the intermediate roof beam member 86 is adapted for insertion within the inner roof beam member 108 as shown in FIG. 13. However, once the intermediate roof beam member 86 is inserted into the inner roof beam member 108, these two roof beam members are securely coupled together in a fixed manner with no relative movement between these two members permitted. As in the previously described embodiment, conventional means such as weldments may be used to securely attach the intermediate roof beam member 86 to the upper end of the support column 84.

Figure 11A:
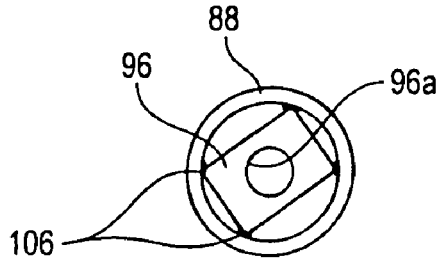
FIG. 11*a* is an end-on view of a portion of the roof beam member shown in FIG. 11.

Attached to an inner end of the outer roof beam member 88 is an end plate 96. End place 96 includes an inner threaded aperture 96*a* and is attached to the inner surface of the proximal end of the outer roof beam member 88 by plural weldments 106 as shown in FIG. 11*a*. Inserted in the threaded inner aperture 96*a* of end plate 96 is a threaded shaft 98. Threaded shaft 98 is securely attached to the end plate 96 by conventional means such as weldments to ensure that the outer roof beam member 88 and the threaded shaft 98 rotate about their aligned longitudinal axes as one piece. The inner end of the threaded shaft 98 is inserted through and engages a lock nut 102. Lock nut 102 is fixedly attached to the inner surface of a second end plate 100 attached to the inner surface of the intermediate roof beam member 86 as previously described. The second end plate 100 includes an aperture aligned with the threaded aperture within the lock nut 102. The end of the threaded shaft 98 is inserted through the aligned apertures within the lock nut 102 and second end plate 100 and threadably engages the lock nut. The outer diameter of the outer roof beam member 88 and the inner diameter of the intermediate roof beam member 86 are such that the outer roof beam member is freely slidable within the intermediate roof beam member with the longitudinal axes of these two members in common alignment.

Inserted through the aperture within the curved end portion 88*a* of the outer roof beam member 88 is end fitting 90. End fitting 90 may be provided with outer threads to fixedly engage inner threads within the aperture in the curved end portion 88*a* of the outer roof beam member. End fitting 90 may also be securely attached in a fixed manner to the outer roof beam member 88 by other conventional means such as weldments so that the end fitting and outer roof beam member 88 are fixedly attached together. The distal end 98 of the end fitting 90 may be provided with a hex or square outer periphery to facilitate its engagement by a conventional tool such as a wrench. Rotation of the combination of the end fitting 90 and outer roof beam member 88 gives rise to a corresponding rotation of the threaded shaft 98 coupled thereto. Rotation of the threaded shaft 98 inserted into and threadably engaging lock nut 102 causes the combination of the end fitting 90 and outer roof beam member 88 to move telescopically into or out of the intermediate roof beam member 86. It is in this manner that the length of the roof rafter may be increased or decreased, as desired.

Disposed about the inner end portion of the end fitting 90 is a connecting ring 94. The distal end 90*a* of the end fitting 90 is greater in size than the inner diameter of the connecting ring 94 so that the connecting ring may not be removed from the combination of the end fitting 90 and the outer roof beam member 88. Connecting ring 94 is freely movable on the end fitting 90. Attached to the connecting ring 94 is an S-hook 92 which is also connected to the cable 82 disposed within and attached to the outer periphery of the fabric roof 80. The outer end of the S-hook 92 may be tightly crimped around the connecting ring 94 so as to prevent its separation from the combination of the end fitting 90 and outer roof beam member 88 and possible loss. Rotation of the combination of the end fitting 90 and outer roof beam member 88 in a counter-clockwise direction as viewed from their distal ends, will result in the outward displacement of the outer roof beam member within the intermediate roof beam member 86 and the lengthening of the roof beam for tightening, or applying greater tension to, the cable 82 for maintaining the fabric roof 80 in a tightly stretched configuration. Rotation of the combination of the end fitting 90 and the outer roof beam member 88 in a clockwise direction as viewed from the end portions of these two roof beam members, will cause the combination of the end fitting and outer roof beam member to move inward telescopically within the intermediate roof beam member 86 so as to reduce or remove tension from the cable 82 resulting in less tension being applied to the fabric roof 80. In this manner, the stretching tension applied to the fabric roof 80 may be easily adjusted to assume virtually any desired value which may be precisely set and maintained.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A building structure comprising:

one or more support columns;

a roof support structure including at least one roof beam attached to an upper portion of said one or more support columns;

a roof comprised of fabric disposed on said roof support structure, wherein peripheral portions of said fabric roof are attached to opposed ends of said at least one roof beam; and wherein said at least one roof beam includes at least one telescoping member associated with and coupled to said at least one roof beam and further includes a forced extension device adapted to telescopingly extend said at least one telescoping member and hold a length of said at least one roof beam so as to displace the peripheral portions of said fabric roof away from inner portions of the fabric roof to thus tension and then maintain said fabric roof in a stretched condition under tension on said roof support structure.

2. The building structure of claim 1, wherein said forced extension device includes a threaded rotatable shaft coupled to said at least one roof beam.

3. The building structure of claim 2, wherein said at least one roof beam is tubular and wherein said threaded shaft is positioned within said tubular beam.

4. The building structure of claim 3, further comprising a cable disposed in the peripheral portions of said fabric roof for engaging at least one telescoping member of a roof beam.

5. The building structure of claim 4, wherein said cable is one of a steel cable or rope.

6. The building structure of claim 5, wherein said fabric roof includes a peripheral hem adapted for receiving said cable.

7. The building structure of claim 4, wherein each said telescoping member includes a hook for engaging said cable.

8. The building structure of claim 1, wherein said at least one beam is tubular and defines an open end, and wherein said at least one telescoping member is disposed at an end of said roof beam and extends through said open end.

9. The building structure of claim 1, wherein said at least one telescoping member includes a plurality of telescoping members.

10. The building structure of claim 9, wherein said roof support structure includes plural roof beams each having first and second opposed ends, and wherein said plurality of telescoping members includes an end-mounted telescoping member disposed on each of said first and second ends of each of said plural roof beams.

11. The building structure of claim 1, wherein said one or more support columns and said at least one roof beam and telescoping member are comprised of tubular steel.

12. A building structure comprising:

one or more support columns;

a roof support structure including at least one roof beam attached to an upper portion of said one or more support columns;

a roof comprised of fabric disposed on said roof support structure, wherein peripheral portions of said fabric roof are attached to opposed ends of said at least one roof beam; and at least one telescoping member coupled to or disposed in said at least one roof beam and further coupled to a peripheral portion of said fabric roof for adjusting the length of said at least one roof beam and maintaining said fabric roof in a stretched condition under tension on said roof support structure; said telescoping members being disposed on opposed ends of each of said roof beams; wherein said roof support structure includes plural roof beams each having first and second opposed ends, with one of said telescoping members being disposed on each of said first and second ends of each of said plural roof beams, wherein at least one of said telescoping member includes first and second axially aligned concentric members and a tension screw coupled to said axially aligned concentric members for displacing said axially aligned members in a telescoping manner relative to one another, an outer one of said concentric members defining a linear cavity with an open end and the screw shaft extending within the linear cavity and through the open end.

13. The building structure of claim 12, wherein said tension screw is located within a distal end of each said roof beam.

14. The building structure of claim 13, wherein said tension screw has a configured end adapted to be engaged by a wrench to twist the screw and extend the end to tension the fabric.

15. The building structure of claim 12, wherein said tension screw is disposed within the concentric members and aligned along a center longitudinal axis of the at least one roof beam.

16. A method for installing a fabric roof having an inner portion and an outer peripheral portion on a building structure including one or more roof beams, said method comprising the steps of:

positioning the fabric roof on said one or more roof beams, the fabric including a perimeter;

attaching the perimeter of the fabric roof to opposed ends of said one or more roof beams; and rotating a threaded shaft to telescopically extend and hold said one or more roof beams so as to displace the perimeter of said fabric roof away from an inner portion thereof and to maintain said fabric roof in a stretched condition on said one or more roof beams.

17. The method of claim 16, wherein the step of telescopically extending said one or more roof beams includes extending a distal end of the roof beam outwardly from a remaining fixed inner portion of the roof beam in a telescoping manner.

18. The method of claim 17, wherein the step of rotating the threaded shaft to telescopically extend and hold said one or more roof beams includes rotating a tension screw having the threaded shaft where the tension screw is disposed in and aligned along a longitudinal axis of the roof beam.

19. A building structure comprising:

at least one support column;

a roof support structure including a plurality of roof beams supported by said at least one support column;

a fabric roof supported on the roof support structure and having a perimeter attached to ends of the roof beams; and at least one of the roof beams being telescopingly extendable and having at least one forced extension device operably connected thereto and configured to forcibly extend a length of the at least one roof beam to an adjusted length dimension to both tension the fabric roof, and to fixedly hold a selected length dimension until again adjusted regardless of increased or decreased tension on the fabric roof due to wind and weather.

20. The building structure defined in claim 19, wherein the forced extension device includes a rotatable threaded shaft engaging a mating threaded member on the end of the at least one roof beam.

21. The building structure defined in claim 19, wherein the at least one forced extension device includes a threaded shaft with a geometrically-shaped head positioned for engagement by an adjustment tool at a location axially aligned with a length of the one roof beam.

22. A method of constructing a building structure comprising steps of:

providing at least one support column;

providing a roof support structure including a plurality of roof beams supported by said at least one support column, at least one of the roof beams being telescopingly extendable;

providing a fabric roof supported on the roof support structure and having a perimeter attached to ends of the roof beams; and providing a forced extension device for forcibly extending a length of the at least one roof beam to a set adjusted position to tension the fabric roof; and forcibly telescopingly extending the at least one roof beam to a selected length causing the at least one roof beam to pull on the perimeter of the fabric roof and tension the fabric roof and then holding the selected adjusted length until again adjusted regardless of increased or decreased tension on the fabric roof due to wind and weather.

23. The method defined in claim 22, wherein the step of forcibly telescopingly extending includes rotating a threaded shaft to extend the at least one roof beam.

24. The method defined in claim 22, wherein the at least one forced extension device includes a threaded shaft with a geometrically-shaped head positioned for engagement by an adjustment tool at a location axially aligned with a length of the one roof beam.

* * * * *